United States Patent [19]

Droeser

[11] Patent Number: 4,485,514

[45] Date of Patent: Dec. 4, 1984

[54] BRUSH RING FOR CLEANSING MACHINES

[76] Inventor: Walter Droeser, Ragnaröksgatan 7, S-723 55 Västerås, Sweden

[21] Appl. No.: 545,344

[22] Filed: Oct. 25, 1983

[51] Int. Cl.[3] ..... A46B 3/16; A46B 7/10

[52] U.S. Cl. ..... 15/179; 15/181; 15/199

[58] Field of Search ..... 15/179, 181, 182, 183, 15/190, 191, 194–199

[56] References Cited

U.S. PATENT DOCUMENTS 1,394,993 10/1921 Frost ..... 15/199

3,228,053 1/1966 Horton et al. ..... 15/183

4,302,863 12/1981 Droeser ..... 15/183

*Primary Examiner*—Peter Feldman

*Attorney, Agent, or Firm*—Young & Thompson

[57] ABSTRACT

A brush ring for a roller brush in a cleansing machine includes a ring with U-shaped cross section and having openings with upstanding walls into which the bent-over ends of the hairpin-like bristle bundles are thrust. The bent-over bristles are free inwards of the inside of the ring, and a locking wire is taken through these ends to form a locking wire ring on the inside of the annular bar for reliably retaining the bristle bundles in the openings when the ring is rotated during operation.

1 Claim, 9 Drawing Figures

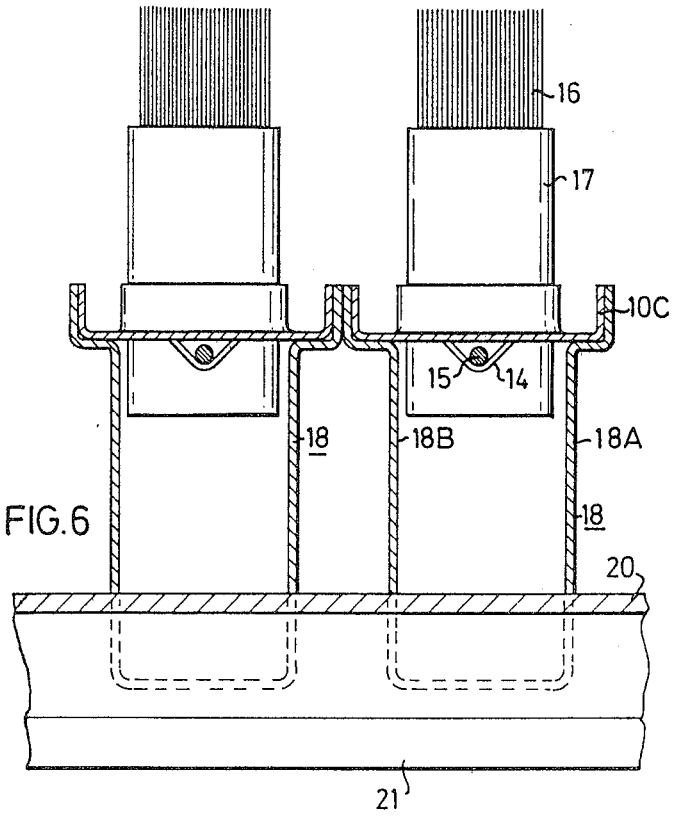
FIG.6
FIG.7
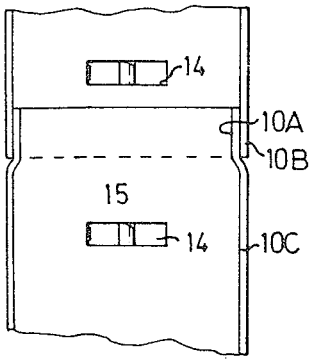
FIG.8
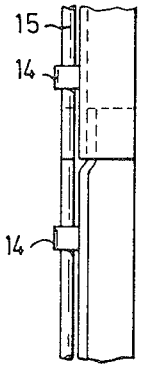
FIG.9
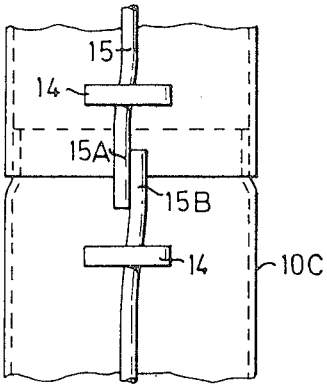

BRUSH RING FOR CLEANSING MACHINES

The present invention relates to a brush ring for cleansing machines intended, inter alia, for airports and streets. A plurality of brush rings are mounted one after the other on a rotor to form a roller brush.

The known brush rings can be manufactured in different ways. In one known method, manufacture starts with a straight U-shaped bar. This is bent into a ring, and its meeting ends are welded together. The hairpin-shaped bristle bundles form an eye at the bent-over end and through this a metal wire is threaded so that the bundles are strung on the wire like beads on a string. With the bristle bundles mounted on it, the wire is subsequently wound round the ring in its U-shaped groove. The wire is tensioned in the groove and the ends of the wire welded together. Since the bristle bundles will be subjected to considerable centrifugal forces during rotation of the roller brush, the metal wire will be subjected to large forces and there is thus the risk that the weld at the ends of the wire will break. Should this happen, all the bristle bundles will be cast off and can injure persons in the vicinity.

Another known brush ring of the kind in question is manufactured by bending two bars to a circular shape and welding them together while the bristle bundles are clamped between the rings, as illustrated in the Swedish Pat. No. 186 616, for example. The rings are kept to each other by spot welding. If one or more welds were to fail, one or more bristle bundles will be cast off with the risk of personal injury.

The object of the present invention is therefore to provide a brush ring where the bristle bundles are retained in a reliable manner and without the risk of rupture in vital weld joints.

This is achieved with a brush ring which has, in accordance with the invention, the characterizing features disclosed in the following claim.

A brush ring manufactured in accordance with the invention is schematically illustrated on the accompanying drawings, as well as a roller brush provided with such rings.

Figure 1:
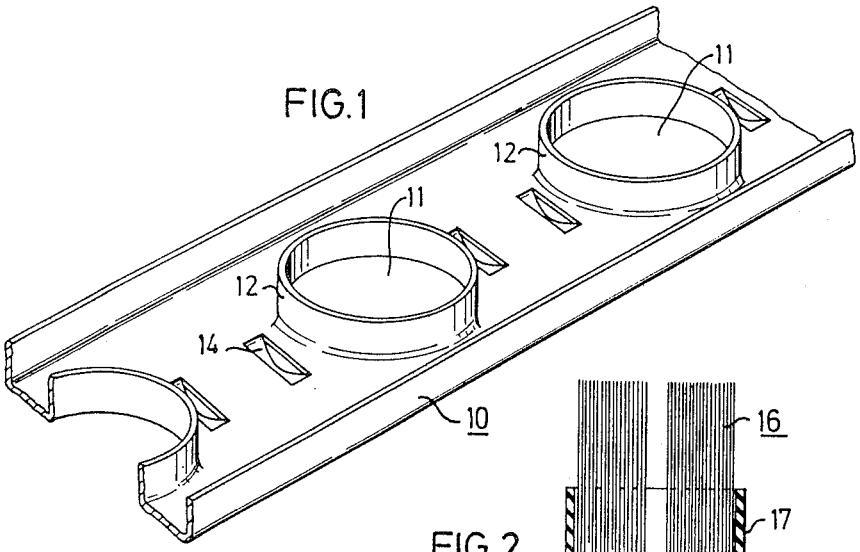
Figure 2:
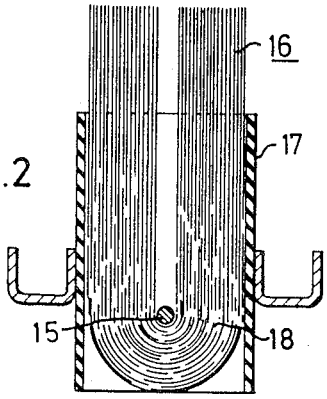
Figure 3:
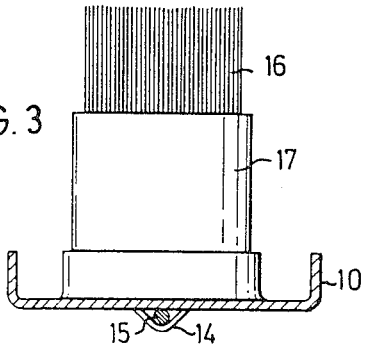
Figure 4:
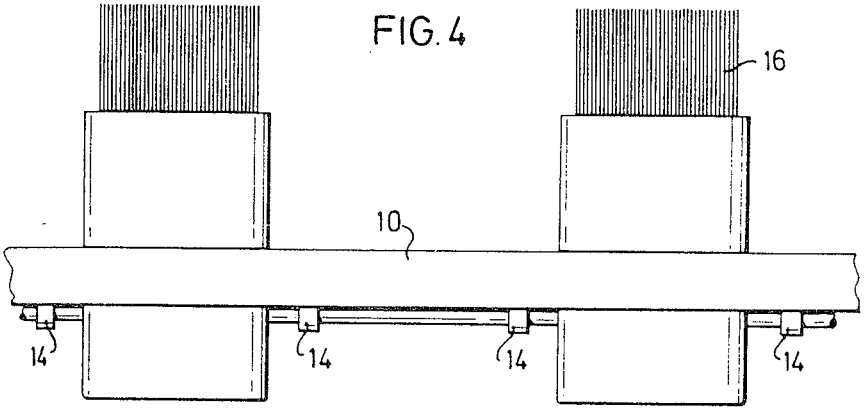
Figure 5:
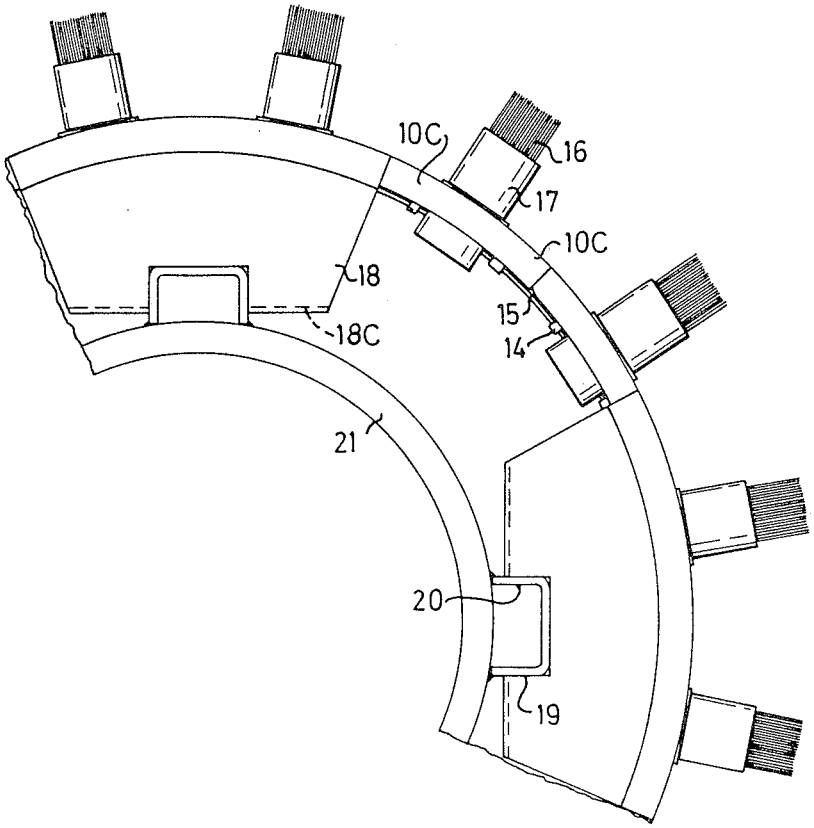

FIG. 1 is a schematic perspective view of a U-shaped bar with openings having upstanding side walls for the reception of hairpin-like bristle bundles, FIG. 2 is a cross section through the bar and a bristle bundle fitted into one of the openings, FIG. 3 is another cross section and illustrates locating means on the underside of the bar for a locking wire which is taken through the bent-over ends of the bristle bundles, FIG. 4 is a side view of the straight bar with the bristle bundles fitted and the locking wire retaining them on the underside of the bar, FIG. 5 is a partial end view to a reduced scale of a brush ring in accordance with the invention and mounted on a rotor, FIG. 6 is a cross section through a pair of brush rings mounted on a rotor, FIG. 7 is a view from above of the joint between the ends of the bar after it has been bent into a ring, FIG. 8 is a side view of this joint, and FIG. 9 illustrates the joint as seen from below.

The sheet metal bar in FIG. 1 is a U-shaped bar 10 formed with extruded openings 11 at uniform spacing.

The extrusions are denoted by the numeral 12 and are intended for providing support for the bristle bundles.

Narrow strips are stamped out and pressed downwards between the openings to form eyelet-shaped location apertures 14 for a locking wire 15 intended for passing through the apertures.

The hairpin-shaped bristle bundles 16 are pressed down into the openings 11 and are downwardly provided with an elastic sleeve 17 for keeping the bundles bent double. At the lower end 18 of the bristle bundle, these wires are bent double and leave an axial channel through which the locking wire is inserted so that the bristle hairpins will be cought by this wire 15 in a manner very reliably retaining the bristle bundle in the opening 11.

Manufacture of the bar with the bristle bundles can be done by machine by the bundles being fitted one after the other in the respective opening 11 while the locking wire 15 is advanced and passed through the wall of the sleeve 17 and through the channel at the bent-over end of the respective bristle bundle.

The length of the bar is selected as being somewhat longer than the circumference of the final brush ring, and this also applies to the length of the locking wire.

The bar is bent up into a ring 10C and mounted on a mandrel having an outer diameter substantially equal to the inner diameter of the final brush ring.

One end 10A of the bar is joggled on three sides to fit the other end 10B, and the overlapping ends are welded together.

The ends 15A, 15B of the locking wire will also overlap, and they are also welded together to form a locking wire ring.

A number of spoke means 18 are arranged inwards of the ring 10C. Each spoke means consists of sheet metal bent into a U-shape with two legs 18A, 18B and a web 18C innermost. An axial slot 19 is made in the web and legs to suit axial splines 20 on the rotor 21. The upper edges of the legs are flanged out forming support for the inside of the ring and guidance for the edges of the ring. The edges are bent upward along the edge flanges of the bar, the raised edges of the legs being welded to said edge flanges.

The brush ring with its spoke means may now be easily mounted on the rotor and in coaction with the axial splines to form a pack of brush rings of desired extension.

Alternatively, the bar 10 can first be bent into a ring, subsequent to which the bristle bundles are mounted in the openings 11 and locked with the locking wire 15. The ends of the bar are finally fastened together as well as the ends of the locking wire.

What I claim is:

1. A brush ring for roller brushes in cleaning machines, comprising a ring having a U-shaped cross section defined by radially extending annular flanges at each side of the ring, the ring having a plurality of uniformly spaced openings therethrough disposed between the flanges, each opening having an upstanding wall thereabout, a bristle bundle of hairpin configuration in each hole with the bend of the hairpin extending through the hole to the radially inner side of the ring, and an annular wire passing through the bends of all the bundles to retain the bundles in position against centrifugal force.

* * * * *